United States Patent [19]

Iwamoto et al.

[11] Patent Number: 4,736,527

[45] Date of Patent: Apr. 12, 1988

[54] APPARATUS FOR THE HEAT TREATMENT OF POWDERY MATERIAL

[75] Inventors: Tutomu Iwamoto, Hino; Kazuhiro Kubouchi, Hachioji, both of Japan

[73] Assignee: Konishiroku Photo Industry Co., Ltd., Tokyo, Japan

[21] Appl. No.: 822,678

[22] Filed: Jan. 23, 1986

Related U.S. Application Data

[63] Continuation of Ser. No. 560,938, Dec. 13, 1983, abandoned.

[30] Foreign Application Priority Data

| | | | |
|---|---|---|---|
| Dec. 13, 1982 | [JP] | Japan | 57-219068 |
| Dec. 13, 1982 | [JP] | Japan | 57-219069 |
| Dec. 31, 1982 | [JP] | Japan | 57-232475 |
| Dec. 31, 1982 | [JP] | Japan | 57-232476 |
| Dec. 31, 1982 | [JP] | Japan | 57-232477 |
| Dec. 31, 1982 | [JP] | Japan | 57-232482 |

[51] Int. Cl.[4] ..... F26B 17/00; B22D 11/01

[52] U.S. Cl. ..... 34/57 E; 264/15

[58] Field of Search ..... 264/15, 117, 345, 503, 264/519, 574; 425/80.1, 103, 445, 384, 383; 34/57 E

[56] References Cited

U.S. PATENT DOCUMENTS

| | | | |
|---|---|---|---|
| 2,929,106 | 3/1960 | Snow | 264/14 |
| 2,972,221 | 2/1961 | Wilke et al. | 264/109 |
| 3,129,086 | 4/1964 | Veatch et al. | 264/14 |
| 3,154,603 | 10/1964 | Witheford | 264/15 |
| 3,190,737 | 6/1965 | Schmidt | 264/15 |
| 3,323,888 | 6/1967 | Searight et al. | 264/15 |
| 3,566,612 | 2/1971 | Eilenberg et al. | 264/117 |
| 3,632,257 | 1/1972 | Ashizawa | 425/222 |
| 3,632,778 | 1/1972 | Sheth et al. | 264/117 |
| 4,137,188 | 1/1979 | Uetake et al. | 264/15 |
| 4,164,534 | 8/1979 | Ogino | 264/117 |
| 4,212,837 | 7/1980 | Oguchi et al. | 264/15 |
| 4,243,794 | 1/1981 | White et al. | 264/15 |
| 4,246,208 | 1/1981 | Dundas | 264/15 |

FOREIGN PATENT DOCUMENTS

| | | | |
|---|---|---|---|
| 86599 | 8/1983 | European Pat. Off. . | |
| 60379 | 5/1978 | Japan . | |
| 140357 | 12/1978 | Japan . | |
| 140358 | 12/1978 | Japan | 264/15 |
| 65175 | 5/1979 | Japan . | |
| 2165 | 4/1980 | Japan . | |

*Primary Examiner*—Jan H. Silbaugh
*Assistant Examiner*—Mary Lynn Fertig
*Attorney, Agent, or Firm*—Jordan B. Bierman

[57] ABSTRACT

A method and apparatus for the heat treatment of a powdery material wherein a flow-circling chamber circles round a powdery material-dispersing airflow and subsequently blows the airflow from a circling flow-blowing nozzle round in the proximity of the inside wall of the flow-circling chamber forming a hollow cone flow. A heated airflow conducting means concurrently applies a heated airflow to the periphery of the hollow cone flow and the material-dispersing airflow is conducted into a heat-treatment chamber wherein the heated airflow is conducted in the same direction as the circling direction of the hollow cone flow.

27 Claims, 5 Drawing Sheets

FIG. 1
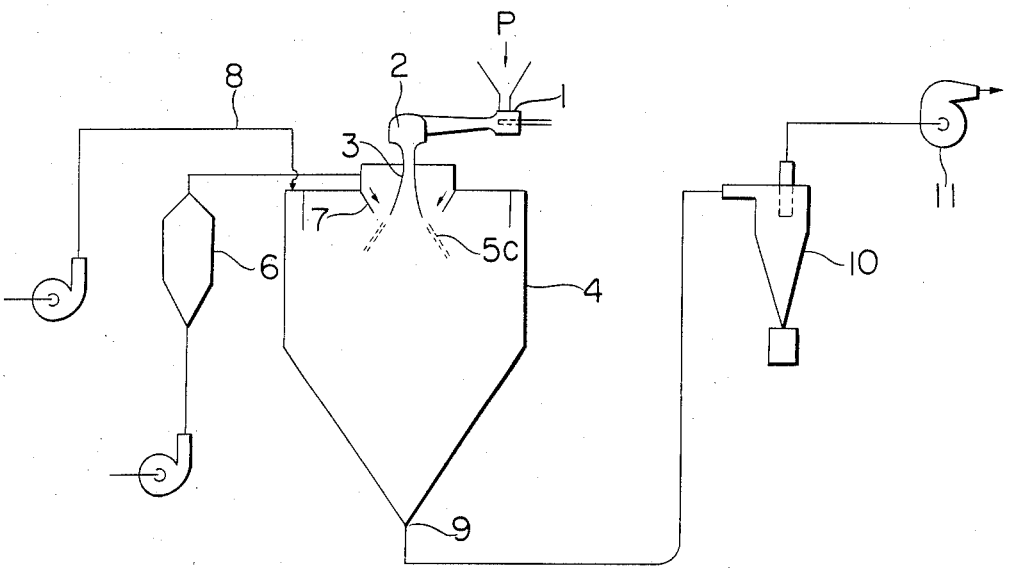
FIG. 2
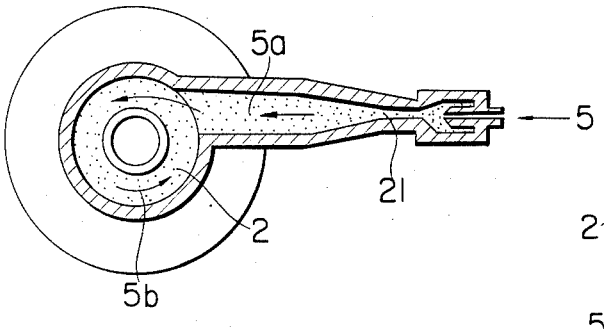
FIG. 3
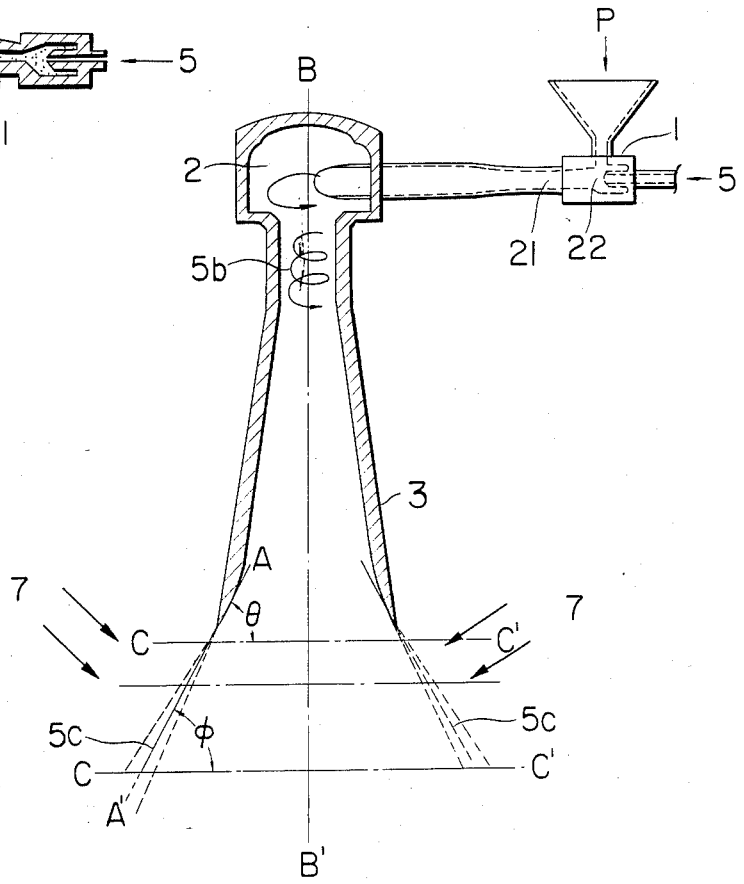
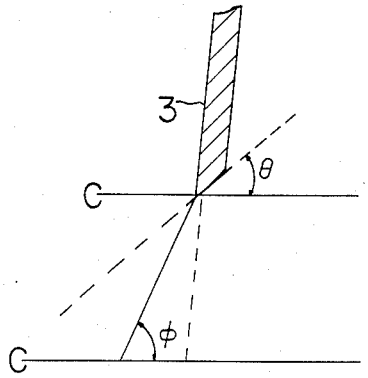
FIG.3a

APPARATUS FOR THE HEAT TREATMENT OF POWDERY MATERIAL

This application is continuation of application Ser. No. 560,938, filed Dec. 13, 1983, now abandoned.

BACKGROUND OF THE INVENTION

The present invention relates to a method for the heat treatment of a powdery material and apparatus therefor, and more particularly to a method for the heat treatment of a powdery material, which method is used for fusing in an airflow to round such particles containing a thermoplastic resin as toner particles for use as, for example, electrophotographic developer, and to apparatus used therefor.

As the method for rounding each of the particles of a powdery material as toner particles, there are known such a wet method as the spray-dry process that a powdery material is dissolved or dispersed into water or an organic solvent to make a solution or dispersed suspension, which is then fine-grained by a two-phase flow nozzle or rotary disc to be sprayed and dried in a heated airflow, and a dry method that toner particles are dispersed into a heated airflow to round the particles.

However, the above wet method has such disadvantageous problems that because the solvent contained in the particles must be mostly evaporated by the time when the sprayed particles are collected, the wet method requires the use of a large drying chamber taking a large spacing for the installation thereof and, if the solvent is nonwater, requires as additional installation for the recovery of the solvent, having possibility of causing such a danger as fire or toxicity to the human body.

On the other hand, the above dry method is also disadvantageous in respect that when heat-treating toner particles whose particle size is in the order of from several microns to several tenths microns there occur the production of coarse-grained toner particles due to the cohesion by thermal fusion of the particles and the adherence of the particles to the spray nozzle in the particle-dispersed airflow and to the internal surface of the chamber wall, thus reducing the yield and productivity, inviting an uneven heat-treatment condition.

One of the causes of the occurrence of the above-mentioned coarse-grained toner particles due to the cohesion by thermal fusion thereof and the uneven heat-treatment condition is such that the toner particles are not uniformly dispersed in the dispersing airflow, and both heated airflow and dispersing airflow are not uniformly thermally dispersed and collidingly mixed.

For example, Japanese Patent Publication Open to Public Inspection (hereinafter referred to as Japanese Patent O.P.I. Publication) No. 140358/1978 discloses a method for blowing a dispersing airflow that circles round in the direction counter to that of a circling pressured heated airflow. In this method, however, not only is it difficult to form a uniform hollow cone-shaped dispersing airflow but the flying high up of the particles by the turbulent air around the orifice of the nozzle cannot be avoided, thus resulting in the increase in the adherence of the particles to the internal surface of the ceiling wall of the heat-treatment chamber.

Further, both round-circling airflows colliding with each other running in opposite directions produce a vigorous air turbulence, causing the toner particles to cohere by thermal fusion thereby to be coarse-grained, thus significantly increasing the adherence thereof to the ceiling wall surface, inviting the deterioration of the yield and productivity, so that the method still remains insufficient to solve such conventional disadvantages.

Japanese Patent O.P.I. Publication No. 60379/1978 discloses a method which is such that for the purpose of preventing the adherence by thermal fusion of thermoplastic particles to the wall of the spray nozzle that sprays a thermoplastic particles-dispersing airflow, the spray nozzle is provided around the periphery thereof with a flow path through which a cooling medium such as water or cooling airflow, thereby cooling the foregoing spray nozzle portion. The method, however, is not advantageous, either, in respect that the temperature of the internal wall of the spray nozzle becomes lowered to below dew point to condense waterdrops on the internal wall surface of the nozzle, causing the adherence of the thermoplastic particles, thus hindering a stable treatment of a large quantity of the particles.

And Japanese Patent Examined Publication No. 2165/1980 describes the conduction of cooling air into between a dispersing airflow and heated airflow for the purpose of preventing the adherence by thermal fusion of particles onto the orifice of the dispersing airflow spray nozzle. In this method, however, the temperature around the heat-encountering zone where the dispersing air and heated air are mixed becomes lowered by the conducted cooling airflow, thus deteriorating significantly the thermal efficiency, and further the flying up of the particles due to the turbulent air at the heat encountering zone cause by the cooling air conduction can not be avoided, so that it is impossible to completely prevent the adherence or cohesion by thermal fusion of the thermoplastic particles to the orifice and internal wall surface of the spray nozzle.

In referring further to the adherence of such particles to the internal wall surface of the chamber, generally speaking, powdery materials have such a nature that the more the particles thereof become finely grained and the lower the ambient airflow rate, the more does the adherence of the particles become increased. And because when adhering to a high temperature wall, the particles become fused, they tend to cause further adherence of other particles, thus producing finally aggregated masses of the fused particles. In the case of toner particles, the melting point and glass transition point thereof, although they depend on the resin used, are about 140° C. and about 60° C., respectively, so that in order to avoid the adherence or cohesion by thermal fusion of the toner that has attached to the heat-treatment chamber wall, the temperature of the wall needs to be lowered to not more than 60° C.

Those heretofore used apparatus for rounding powdery particles of the kind adopt a method of either forcibly moving the particles by cooling means provided at the lower part of the apparatus or of conducting a cooled airflow into the midway of the recovery path for the heat-treated particles. These methods, however, are not designed so as to provide the prevention of the particles from attaching to the internal wall surface of the heat-treatment chamber and the cooling of the wall surface, so that they cannot avoid the adherence by thermal fusion of the powdery material or the occurrence of aggregated masses of the powdery material particles, so that if fragments of such attaching matter or masses come into the manufacturing product of toner during the course of the heat-treatment operation or during the time of cleaning after the operation, the product becomes defective, and removal of the defective lots leads to a large deterioration of the yield. If an attempt is made to reduce as much as possible the adherence by thermal fusion of or the attaching of toner particles, any high productivity of the toner cannot be carried out, and besides, the chamber needs to be of a much larger size.

SUMMARY OF THE INVENTION

It is therefore an object of the present invention to provide a method for the heat treatment of a powdery material and apparatus therefor, the method and apparatus being capable of rounding the particles of a thermoplastic powdery material for use as electrostatic recording toner and the like with a high yield and a high productivity and without causing any coarse-grained particles due to the cohesion by thermal fusion and the attaching of the particles to the nozzle that blows a particles-dispersing airflow and to the internal surface of the wall of the heat-treatment chamber.

The above object is accomplished by a method for the heat treatment of a powdery material that a powdery material-dispersing airflow is circled round inside a flow-circling chamber and then circled round in the proximity of the internal wall of a circling airflow-blowing nozzle to be blown out therefrom to thereby form in a heat-treatment chamber a hollow cone flow of the powdery material from the orifice of the nozzle, and at the same time a heated airflow is conducted from the outside of the periphery of the hollow cone flow, thereby carrying out the heat treatment of the powdery material, and by means of powdery material-heat-treating apparatus used for the purpose of carrying out the above method, the apparatus comprising a flow-circling chamber for circling round a powdery material-dispersing airflow; a circling flow-blowing nozzle which blows the powdery material-dispersing airflow with letting it circle round in the proximity of the internal of the wall thereof to thereby form a hollow cone flow of the powdery material; heated airflow-conducting means which conducts a heated airflow from the outside of the periphery of the foregoing hollow cone flow; and a heat-treatment chamber.

The words "uniform hollow cone flow" used herein means that the powdery material particles are uniformly dispersed in the concentrically circling direction, and individual toner particles are in a stable hollow cone flow at an angle almost equal to the blowing angle.

BRIEF DESCRIPTION OF THE INVENTION

FIG. 1 is a flow diagram of the heat treatment of powdery material particles in the present invention.

FIG. 2 is a plan view of the ejector-having flow-circling chamber section of the apparatus of FIG. 1.

FIG. 3 is a cross-sectional view of the device for forming a hollow cone flow.

FIG. 3*a* is an enlarged fragmentary view of a part of FIG. 3.

Figure 4:
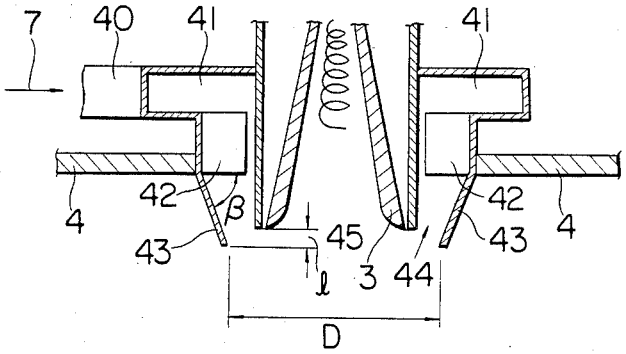

FIG. 4 is a cross-sectional view of the heated airflow conducting section.

Figure 5:
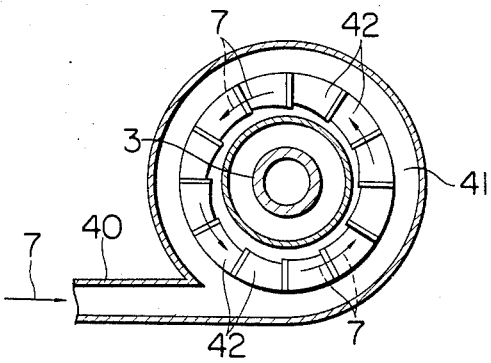

FIG. 5 is a plan view of the heated airflow conducting section.

Figure 6:
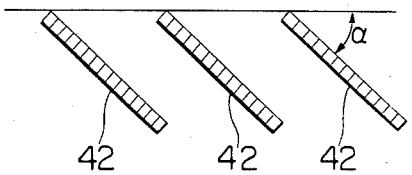

FIG. 6 shows the angle of the heated airflow guide blades.

Figure 7:
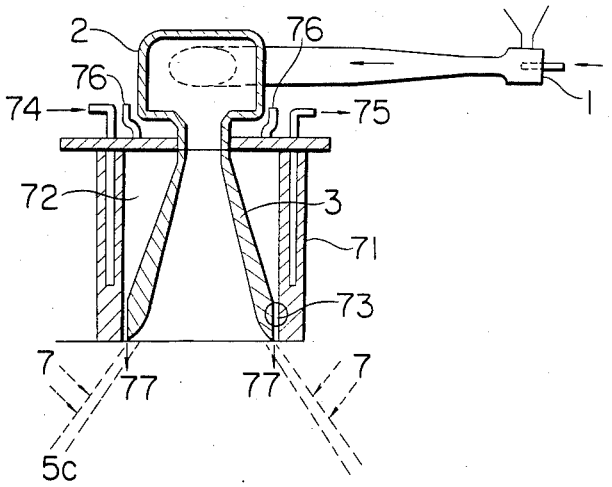
Figure 8:
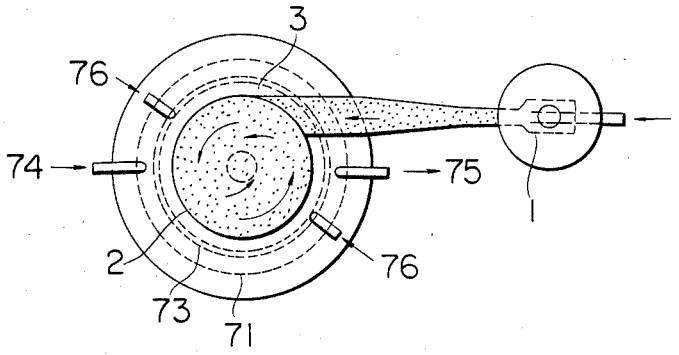

FIGS. 7 and 8 are cross-sectional view and plan view, respectively, of the hollow cone flow forming device provided around the periphery of the circling flow-blowing nozzle thereof with cooling jacket and air curtain forming gap.

Figure 9:
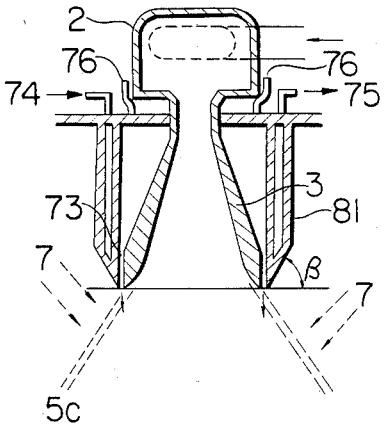

FIG. 9 is a cross-sectional view of the device having a cooling jacket different in the form from that shown in FIGS. 7 and 8.

Figure 10:
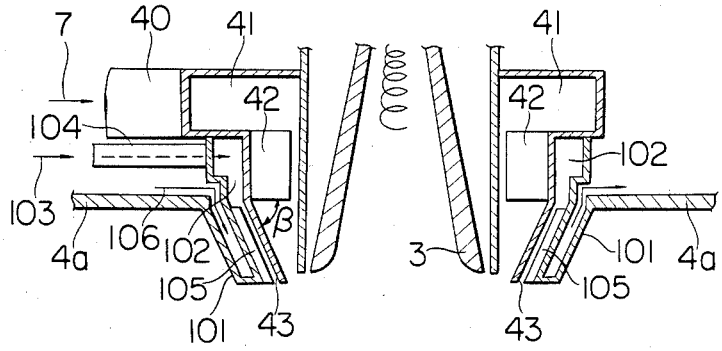
Figure 11:
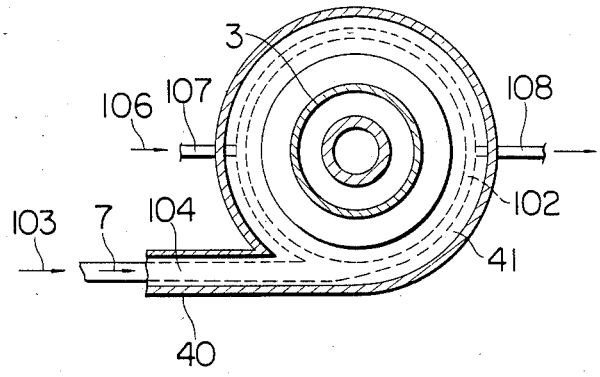

FIGS. 10 and 11 are cross-sectional view and plan view, respectively, of the hollow cone flow forming device having around the periphery of the heated airflow blow-off outlet thereof a cooling airflow conducting section and a cooling jacket.

Figure 12:
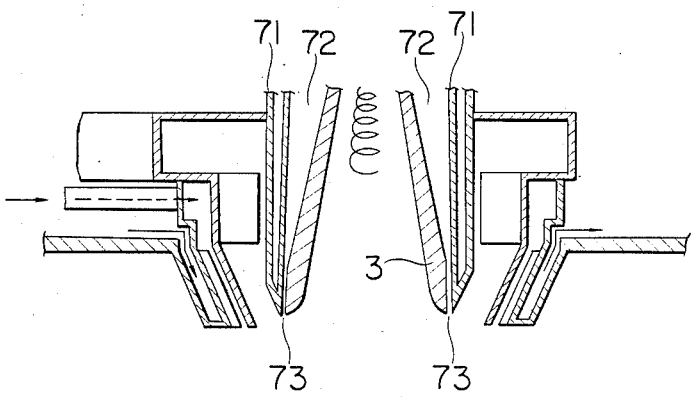

FIG. 12 is a cross-sectional view of the hollow cone flow forming device having around the periphery of the circling flow-blowing nozzle thereof an air curtain forming gap and a cooling jacket, and around the periphery of the heated airflow blow-off outlet thereof a cooling airflow conducting section and a cooling jacket.

Figure 13:
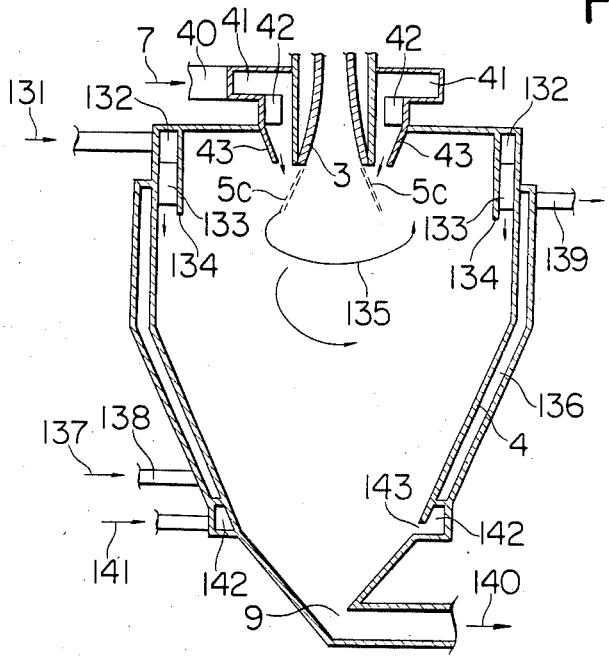
Figure 14:
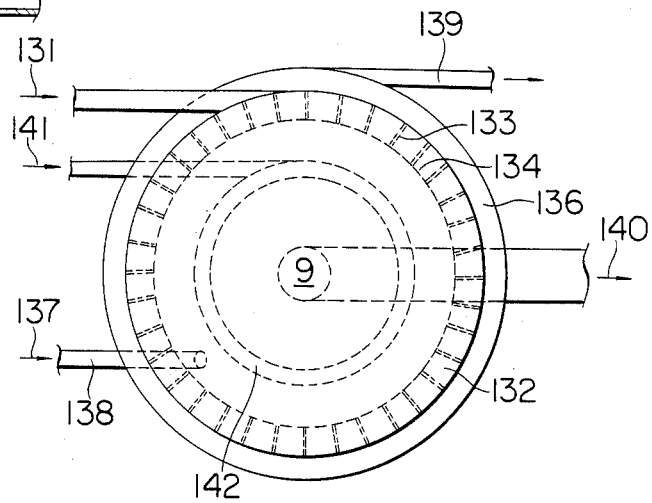

FIGS. 13 and 14 are cross-sectional view and plan view, respectively, of the heat-treatment chamber having along and at the upper part of inside surface of the side wall thereof upper cooling airflow conducting means and at the lower part of the side wall thereof lower cooling airflow conducting means, and also having around the periphery of the external of the wall thereof a cooling jacket.

Figure 15:
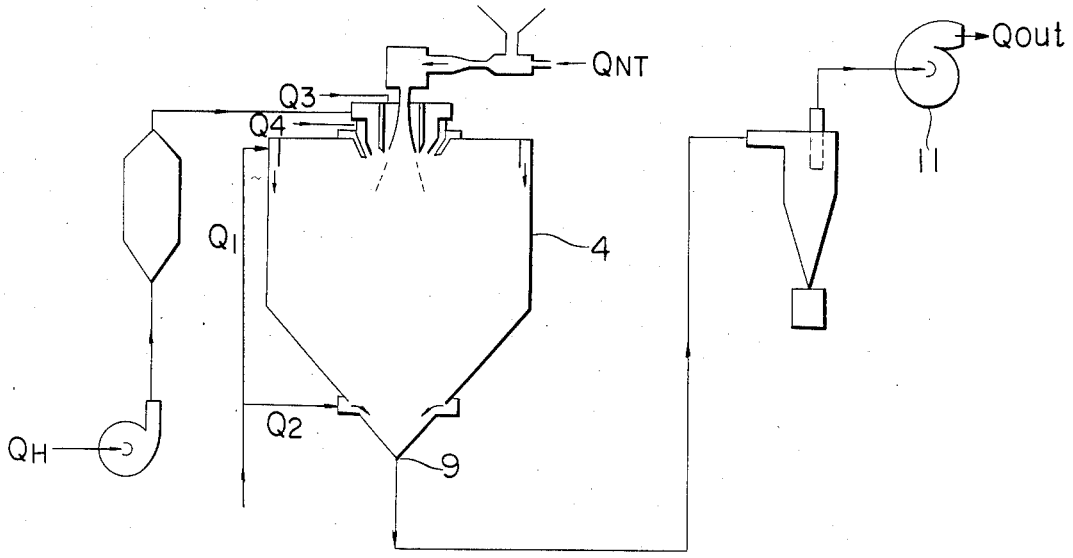

FIG. 15 is a flow diagram showing the airflow supply to and exhaust air from the heat-treatment chamber.

DETAILED DESCRIPTION OF THE INVENTION

FIG. 1 is a typical flow diagram of the apparatus for carrying out the heat treatment of thermoplastic powdery material particles in the present invention (hereinafter called powdery particles or merely called particles).

Untreated powdery material P is put in ejector 1, and the powdery material-dispersing airflow produced in ejector 1 is circled round in flow-circling chamber 2 and then blown from circling flow-blowing nozzle 3 located underneath the flow-circling chamber into heat-treatment chamber 4 to thereby form a hollow cone flow 5C. To the dispersing airflow is blown a heated airflow 7 heated by heater 6 in the direction of the arrow to thereby carry out a thermally-particle-rounding treatment. Heat-treatment chamber 4 is provided in the proximity of the side wall thereof with a cooling airflow conducting inlet through which cooling airflow 8 is conducted into heat-treatment chamber 4. The rounded particles are cooled by the cooling airflow, and then brought through air exhaust outlet 9 to be collected by cyclone collector 10. 11 is an air-exhaust device for exhausting the air from heat-treatment chamber 4.

FIG. 2 is a plan view of the ejector and flow-circling chamber section of FIG. 1. The figure show the condition wherein dispersing airflow 5*a* of the particles dispersed at ejector throat 21 by compressed air 5 is blown in the tangential direction into flow-circling chamber 2 to thereby become circling flow 5*b*.

FIG. 3 is a cross-sectional view of the device for rendering the dispersing airflow containing the particles in the present invention a uniform hollow cone flow, the device comprising ejector 1, flow-circling chamber 2, and circling flow-blowing nozzle 3. When compressed air 5 is jetted from the nozzle therefor into mixing chamber 22, powdery material particles P are sucked together with the air from a hopper into ejector throat 21 wherein the particles are subjected to a strong shearing force, whereby aggregated particles are pulverized to become uniformly dispersed. The linear rate of the dispersing airflow inside ejector throat 21 is from 150 to 450 m/sec., and preferably from 200 to 400 m/sec. Further, the particles-dispersing airflow is circled round inside flow-circling chamber 2 to be blown, so that it is blown, keeping a given blowing angle, in a nearly uniform particles concentration and at a given linear rate, from the tip of the nozzle. The powdery material particles-dispersing airflow blown at the time is in the form of a uniform hollow cone flow 5C, in which case the blowing angle $\phi$ of the particles is almost constant and almost equal to the extension angle $\theta$ at the tip of the circling flow-blowing nozzle, the blowing angle $\phi$ being the angle of the mean cone plane A of the hollow cone formed when the particles in the dispersing airflow are blown from the tip of the circling flow-blowing nozzle to the plane C—C' which crosses at right angles with the center line B—B'; the extension angle $\theta$ of the nozzle being the angle of the tangential line of the internal wall at the tip of the circling flow blowing nozzle to the plane C—C' which crosses at right angles with the foregoing center line. In other words, angle $\phi$ is the average of the actual angles of dispersion of the flow. The range is shown in dotted lines.

Blowing heated airflow 7 to the thus formed hollow cone flow 5C from the outside of the periphery thereof to thereby thermally round the particles enable not only to produce a nonbiased particle concentration, preventing the occurrence of possible cohesion of the particles or coarse-grained particles due to the thermal fusion but to make constant the period of being in contact of the particles with the heated airflow (staying period in the hot zone), so that there arises no insufficient heat treatment of the particles, thus enabling to produce excellently uniformly rounded powdery particles at a rapid rate and high yield. And because the heat treatment of the particles takes place mainly in the central space of heat-treatment chamber 4, little adherence of the particles by thermal fusion to the internal surface of the wall is brought about, so that continuous heat-treatment operations can be carried out.

In the practice of the above method, the concentration of the powdery particles in the dispersing airflow is preferably not more than 300 g/m$^3$, and more preferably not more than 150 g/m$^3$. If the particle concentration exceeds 300 g/m$^3$, it tends to produce coarse-grained particles due to the cohesion by thermal fusion.

The extension angle $\theta$ of the tip of the foregoing nozzle is preferably from 30° to 70°, and more preferably from 40° to 60°.

The conducting direction of the foregoing heated airflow is desirable to be the same as the circling direction of the hollow cone flow of the particles-dispersing airflow formed by the circling flow-blowing nozzle.

The foregoing heated airflow conducting means is desirable to be of such a construction comprising guide blades which guide downward the heated airflow with letting it circle round in the same direction as the circling direction of the foregoing hollow cone flow, and airflow direction control plate 43 provided in the heated airflow path around the circling flow-blowing nozzle, which control plate blows the heated circling airflow from the guide blades with narrowing the airflow down in the direction of the center line of the foregoing circling flow-blowing nozzle.

An example of the above-mentioned heated airflow guide means are shown in FIGS. 4 to 6, wherein the heated airflow guide means comprises heated airflow supply pipe 40, heated airflow-circling chamber 41, circling flow guide blades 42, and airflow direction control plate 43. Heated airflow 7 heated to a temperature of from 300° to 400° C. is blown in the tangential direction into and circled round inside heated airflow-circling chamber 41, and then guided by circling flow guide blades 42 down with keeping circling at a downward angle $\alpha$ in the axial direction. This flow can be positively produced by flow-circling guide blades 42 which is fixed onto the wall surface, as shown in FIG. 5, with the blades each fixed along the periphery with an inclination at a downward angle $\alpha$ (see FIG. 6). And the heated circling airflow from guide blades 42 further continues circling, with being narrowed down in the central (axial) direction of nozzle 3 by airflow direction control plate 43 that is in the inverse trapezoidal cone form inclined at a downward angle $\beta$ to the horizontal plane, and then blown out through bottom outlet 44 into heat-treatment chamber 4. The above angle $\alpha$ is a parameter which determines the strength of the heated circling airflow, and the smaller the angle $\alpha$, the more does the circling flow become dominant than the axial flow. The angle $\alpha$ is preferably from 15° to 85° (more preferably from 30° to 75°). If the angle $\alpha$ is less than 15°, the effect of providing the guide blades becomes smaller, deteriorating the thermal efficiency because the particles blown out of blowing orifice 45 become flown up by the heated airflow to adhere to the upper wall surface of heat-treatment chamber 4 or the heated airflow from blow-off outlet 44 tends to become spread around. If the angle $\alpha$ exceeds 85°, the hot zone by the heated airflow becomes narrower, so that the heat treatment is possibly allowed only in the proximity of blow-off outlet 44. The inclination angle $\beta$ of airflow direction control plate 43 controls the heated airflow direction range of from the axial direction of circling flow-blowing nozzle 3 to the downward or outward direction. The angle $\beta$ is preferably from 15° to 85° (more preferably from 30° to 75°). If the angle $\beta$ is less than 15°, it produces a turbulence of the heated airflow, tending to cause the particles to attach to the inside of the control plate or to the tip of the circling flow-blowing nozzle, and also tending to make smaller the zone which enables the heat treatment. If the angle $\beta$ exceeds 85°, it becomes difficult to narrow the heated airflow down in the axial direction, deteriorating the thermal efficiency. Accordingly, the blowing angle of the heated airflow and the strength of the heated air circling flow can be determined by use of an appropriate angle $\alpha$ or $\beta$, or in an appropriate combination of the angles $\alpha$ and $\beta$, so that the particles-dispersing airflow from nozzle 3 and the heated airflow from blow-off outlet can sufficiently collide with each other to be mixed, and the heating temperature distribution in the heat-encountering zone (heating zone) can be controlled, so that the particles' heat-treatment condition can also be controlled.

In FIG. 4, in the case where the difference between the height of the bottom end of circling flow-blowing nozzle 3 and the height of the bottom end of airflow direction control plate 43 is regarded as l, in order to obtain a satisfactory particles' heat-treatment condition, the height of the bottom end of nozzle 3 should be almost the same as or a little above that of the bottom end of control plate 43, and the difference l is desirable to have the relation of:

$$0 \leqq l \leqq D/4$$

wherein D represents the diameter of the bottom end of control plate 34.

As described above, the heated airflow is blown from blow-off outlet 44 to be extended over the entire space of the particles-dispersing airflow, and at this time, both blowing angle and quantity of the heated airflow become fixed, so that the temperature distribution in the heating zone becomes completely symmetrical with respect to the axis of nozzle 3. Consequently, the individual particles in the dispersing airflow receive a given quantity of heat from the heated airflow, so that the heat-treatment condition is always fixed, and thus homogeneously rounded particles can be obtained. The heating zone becomes spreading outwardly in accordance with the hollow cone flow, so that the probability that the particles, immediately after being subjected to the heat treatment, come into contact with one another to be fused to cohere is reduced to thereby enable to restrain the production of coarse-grained particles due to the cohesion by thermal fusion.

In the apparatus of the present invention, for the purpose of preventing the adherence by thermal fusion of the particles to the periphery and the tip of the circling flow-blowing nozzle, it is desirable to form an air curtain. The air curtain can be produced by making a cooling airflow through the gap between a cooling jacket provided around the periphery of the circling flow-blowing nozzle and this circling flow blowing nozzle.

FIG. 7 shows an example of such the apparatus provided around the periphery of the circling flow-blowing nozzle thereof with a cooling jacket and a gap provided therebetween, the nozzle having a similar structure to what has been described above. Around circling flow-blowing nozzle 3 an inside-hollow cooling jacket 71 is located so as to surround the periphery of nozzle 3 with a space 72 formed therebetween and with gap 73 formed at the bottom-end periphery of nozzle 3 therebetween. Further jacket 71 has at the wall's top portion thereof a cooling medium conduction pipe 74 and a cooling medium exhaustion pipe 75, both of which pierce through the top portion into the wall, and a compressed air conduction pipe 76 is connected to the top wall above space 72.

From circling flow-blowing nozzle 3 a particles-dispersing airflow is blown in the form of a hollow cone flow, and at this time, compressed air is conducted into space 72 from pipe 76, whereby an airflow is jetted out through gap 73 to form an air curtain. Further, by circulating such a cooling medium as cold water or cold airflow through the cooling jacket that is provided around the periphery of gap 73, nozzle 3 and the inside of the nozzle 3 can always be kept at a temperature almost equal to room temperature without being affected by the temperature of heated airflow 7 around the periphery of cooling jacket 71, and thus the adherence by thermal fusion of the particles to the inside wall of the blowing nozzle can be prevented and at the same time, because there is no direct contact of nozzle 3 with cooling jacket 71 with gap 73 provided therebetween, the temperature of the nozzle's inside wall is prevented from being lowered below dew point, so that the attaching of the particles by waterdrops will not occur.

The air curtain 77 jetted out through the gap enables to prevent the attaching of the particles to the tip of nozzle 3 and also to prevent the occurrence of icicle-shaped deposits of the particles onto the tip of the nozzle.

The cooling medium for use in the circulation into the cooling jacket may be water or other mediums at a temperature of not more than 50° C. The compressed air should be jetted through gap 73 in the slit form which is preferably from 0.3 to 2.0 mm wide at a temperature of not more than 50° C. and at a linear jetting speed of preferably from 10 to 40 m/sec. The flow quantity of the air curtain should be much smaller than that of dispersing airflow 5*a*. By doing this way, the attaching and adherence by thermal fusion of the particles to the tip of the nozzle can be prevented without causing any turbulence of the temperature distribution around the heat-encountering space and any deterioration of the thermal efficiency.

FIG. 8 is a top plan view of the apparatus of FIG. 7. FIG. 9 is a cross-sectional view of another example of the heat-treatment apparatus of the present invention. The apparatus of FIG. 9 has cooling jacket 81 whose tip is so acute-angled as to be in parallel with the inclination angle $\beta$ of plate 43. By doing this, the turbulence of the heated airflow can be prevented to improve the thermal efficiency as well as to largely improve the effect of preventing the attaching of the particles to jacket 81.

In the apparatus of the present invention, for the purpose of preventing the adherence by thermal fusion of the particles to around the periphery of the blow-off outlet of the heated airflow, it is desirable to provide a cooling airflow conducting section around the periphery of the blow-off outlet of the heated airflow, and further to provide a cooling jacket around the periphery of the same conducting inlet.

FIGS. 10 and 11 are cross-sectional view and plan view, respectively, of apparatus having the foregoing cooling airflow conducting inlet and cooling jacket which are provided around the periphery of the heated airflow blow-off outlet of the particles-dispersing circling airflow-blowing nozzle having heated airflow conducting means as shown in FIG. 4.

Airflow direction control plate 43 is provided therearound with a cooling water jacket 101. Jacket 101, heated airflow-circling chamber 41 and airflow direction control plate 43 together form an inverse trapezoidal cone-shaped cooling airflow-circling chamber 102. Accordingly, when the particles-dispersing airflow and heated airflow collide with each other to be mixed as previously described, cooling airflow 103 is conducted through supply pipe 104 into flow-circling chamber 102, and then blown with being circled round by circling flow guide blades 105 through the bottom end of the slit space out into the heat-treatment chamber. At the same time, cooling water 106 comes through cooling water conduction pipe 107 into jacket 101 to cool the wall, and then is discharged through cooling water drain pipe 108.

Thus, by circulating cooling airflow and water around the heated airflow conducting section, a cooled air is flown about the tip of airflow direction control plate 43 and the outside wall thereof, so that it can prevent the attaching and adherence by thermal fusion of the particles to them. In addition, the periphery further comprises the wall of cooling water jacket 101, so that the wall surface temperature becomes equal to the cooling water temperature (about 20° C.) and top wall (ceiling) 4*a* of heat-treatment chamber 4 is as much sufficiently cooled as below 40° C. even if the temperature inside heat-treatment chamber 4 would be high due to the heat conduction between the chamber and cooling water jacket 101. Consequently, even when the particles are flown up by a turbulent air to attach to the side wall and ceiling, there would never occur any adherence by thermal fusion of the particles.

In order to restrain the attaching of the particles to the outside of the wall of jacket 101 and ceiling 4a of heat-treatment chamber 4, dimensional relations should be adopted in such a way that if the distance between the bottom-end position of airflow direction control plate 43 and ceiling 4a of the heat-treatment chamber is regarded as m, the distance between the bottom-end position of jacket 101 and ceiling 4a should be $(1\pm0.2)$m, and if the internal diameter of the bottom end of airflow direction control plate 43 is regarded as D, the D should have the relation of $D/10 \leqq m$. In addition, in FIGS. 10 and 11, 7 is a heated airflow, 40 is a heated airflow supply pipe, and 42, although not shown in FIG. 11, is heated airflow guide blades.

The foregoing cooling airflow conducting section and cooling jacket provided around the heated airflow blow-off outlet are desirable to be used in combination, as shown in FIG. 12, with the cooling jacket provided around the periphery of the opening of the circling flow-blowing nozzle.

In FIG. 12, 71 is a cooling jacket cooled by a cooling medium. 73 is a gap space for the formation of an air curtain. A cooled airflow is brought into gap 72 between nozzle 3 and cooling jacket 71. The configurations and functions of other members are similar to those of the example in FIG. 10, and the notations used are also the same as those used in the same figure.

In the heat-treatment chamber of the apparatus for heat-treating powdery particles in the present invention, it is desirable to provide cooling airflow conducting means along the internal surface of the side wall of the chamber and a cooling jacket around the external periphery of the side wall of the chamber. The provision of these means enables to effectively prevent the adherence by thermal fusion of the particles to the wall surface and also effectively cool the mixed airflow containing the heat-treatment-completed particles.

As the foregoing cooling airflow conducting means there may be advantageously utilized the cooling airflow guide plate provided at the upper portion of the side wall of the heat-treatment chamber and the cooling airflow regulation plate that regulates the cooling airflow to be in the slit form. It is also desirable to provide a second cooling airflow conducting means at the lower part of the heat-treatment chamber along with the foregoing cooling airflow conducting means and the cooling jacket around the periphery of the side wall for the purpose of improving and increasing the foregoing effect.

FIG. 13 is a cross-sectional view of an example of the heat-treatment apparatus provided in the heat-treatment chamber thereof with the aforementioned cooling airflow conducting means, provided around the periphery of the side wall thereof with the cooling jacket, and also provided at the lower part of the chamber thereof with the above-mentioned second cooling airflow conducting means, and FIG. 14 is a plan view of the same apparatus.

In heat-treatment chamber 4, particles-dispersing airflow 5C encounters with heated airflow 7, and the particles fall with being circled round downward, and at the same time, in the upper portion of the side wall, cooling airflow 131 is blown with being circled round in the tangential direction into cooling airflow-circling chamber 132, and then guided by vertical guide blade 133 and regulated by cooling airflow regulation plate 134 to be blown out in the vertical slit form down along the axial direction of the heat-treatment chamber. As a result, the upper cooling airflow 131 prevents the attaching of the particles to the side wall of the heat-treatment chamber, and at the same time, mixes with and cools a mixture of both particles-dispersing airflow and heated airflow. In the conduction of the above cooling airflow, cooling airflow regulation plate 134 prevents the airflow in the heat encountering zone (hot zone) of particles-dispersing airflow 5C and heated airflow 7 from being disturbed, thus leading to restraining the flying up of the particles to attach to the ceiling and side wall of the heat-treatment chamber. However, if the upper cooling airflow 131 is a circling flow, the particles would be increasingly flown up to attach to the ceiling and centrifugally circled around to attach to the side wall of the chamber. However, because vertical guide blade 133 guides the upper cooling airflow 131 to flow down along the axial direction, the attaching caused by such a phenomenon as above can be prevented.

Subsequently, in order to completely prevent the adherence by thermal fusion of or cohesion of the particles that have attached to the side wall of the chamber, a cooling jacket 136 is provided around the external periphery of the side wall of the chamber, and into the jacket is circulated cooling airflow 137 from inlet 138, and the exhausted from outlet 139. At this time, the circulated cooling airflow's quantity and temperature are to be controlled so that the temperature of the side wall becomes lowered to not more than 50° C. At the same time, on the side wall surface, cooling by heat release of the mixture of heated airflow can be expected.

Further, in the recovery of the particles, in order to prevent the cohesion of the particles, the temperature of exhausting airflow 140 from the heat-treatment chamber needs to be lower than the particles' glass transition point; in the case of electrostatic recording toner, not more than 60° C., and preferably not more than 50° C., so that the lower cooling airflow, 141 should first be conducted through the lower part of the heat-treatment chamber into flow-circling chamber 142 and then through conducting inlet 143 into the lower space inside the heat-treatment chamber to thereby cause the exhausting temperature to be equal to or less than 50° C.

When conducting a cooling airflow, if the upper cooling airflow 131 alone is used to obtain a sufficient cooling effect, the conducting quantity of the airflow needs to be increased, causing a turbulent airflow in the heated airflow's encountering zone (hot zone) due to an accompanying airflow, thereby resulting in the increase in the attaching of the particles to the ceiling and side wall of the heat-treatment chamber. On the contrary, if the lower cooling airflow 141 alone is used, a mixture of particles-dispersing airflow 5C and heated airflow 7 and an airflow accompanying the same increase the attaching of the particles to the ceiling and side wall of the chamber.

That is, as in this example, a cooling airflow is conducted from both upper part and lower part of the side wall of the heat-treatment chamber, and a cooling airflow 131 in as much sufficient a quantity as capable of restraining the attaching of the particles to the side wall and an airflow accompanying the mixture of heated airflows is supplied from the upper part of the side wall, and on the other hand, a cooling airflow 141 in as much sufficient a quantity as capable of lowering the air-exhausting temperature to a temperature of not more than 50° C., and a cooling airflow or cooling water is circulated into cooling jacket 136 so that the temperature of the side wall becomes lowered to not more than 50° C., whereby the particles can be prevented from adhering by thermal fusion or attaching to the side wall of the heat-treatment treatment chamber, and the mixture of heated airflows can be cooled, so that the heat-treatment operation can be carried out with keeping a continuously high yield and a high productivity.

In addition, in the present example, the heated airflow is conducted through bottom outlet 44 to be blown out over the entire space of the particles-dispersing airflow, and at this time the blowing angle and quantity of the heated airflow become settled, so that the temperature distribution in the hot zone is symmetrical with respect to the axis of nozzle 3. As a result, the individual particles in the dispersing-airflow receive a fixed quantity of heat from the heated airflow, so that the heat-treatment condition is always stably settled, whereby a homogeneously rounded particles can be obtained. The hot zone becomes diffusing outward with circling round in accordance with the previously mentioned hollow cone flow, there becomes further reduced the probability of the particles, immediately after being subjected to a heat treatment, to come into contact with one another to become fused to cohere, thereby completely preventing the occurrence of coarse-grained particles due to the cohesion thereof by thermal fusion. Besides, the attaching of the particles to the wall of the chamber by the flying up of the particles according to the hollow cone flow can also be prevented. Thus, along with the above-described reason, the rounding of the particles can be performed with a satisfactory yield and productivity.

The present invention is subsequently illustrated in detail in reference to examples of the heat treatment of electrostatic recording toner.

When a continuous heat-treatment operation was performed for 10 hours under the following conditions:
concentration of toner particles-dispersing airflow:
100 g/m$^3$,
quantity of heated airflow: 14 Nm$^3$/min.,
temperature of heated airflow: 360° C.,
upper cooling airflow: 40 m$^3$/min.,
lower cooling airflow: 40 m$^3$/min.,
jacket cooling airflow: 20 m$^3$/min., and
temperature of cooling airflows: 15° C.,
then, it was found that, after completion of the operation, little toner particles were found attaching to the ceiling and side wall, and those which had attached to the side wall neither adhered thereto nor cohered at all. As a result, all were deemed recoverable as a product of toner.

The particles-dispersing airflow-blowing section shown in FIG. 13 is one comprised only of the circling flow-blowing nozzle and the heated airflow conducting means shown in FIG. 4, but as this blowing section there may be preferably used one comprising the circling flow-blowing nozzle shown in FIGS. 7 and 9 which has therearound a cooling jacket and cooling air curtain forming means, or one comprising the heated airflow blow-off outlet shown in FIG. 10 which has therearound a cooling jacket and cooling airflow conducting section. And the most preferably useable is on comprising both the circling flow-blowing nozzle and the heated airflow blow-off outlet shown in FIG. 12 each having therearound a cooling jacket and cooling airflow conducting means.

The heat treatment of powdery material by use of the method and apparatus of the present invention is to be carried out under the condition of a reduced pressure inside the heat-treatment chamber of preferably from −400 to 0 mm $H_2O$, and particularly preferably from −120 to −40 mm $H_2O$. The reduction of the inside pressure of the heat-treatment chamber can be carried out by increasing the quantity of the air exhausted from the heat-treatment chamber by exhauster 11 (see FIG. 15) over that of the air supplied to the chamber.

If the inside pressure of the heat-treatment chamber is reduced as described above, the toner particles are smoothly moved toward exhaust outlet 9 to be heat-treated, so that the attaching of the particles to the wall due to the flying up of the particles can be effectively prevented, and the mixed flow comprised of the particles-dispersing airflow with the heated airflow can be easily and sufficiently cooled, thereby enabling to carry out a uniform heating and cooling. Besides, because the discending speed of the particles inside the chamber is accelerated to shorten the particles' staying period, the degree of the adherence by thermal fusion of the particles is largely reduced, thus accomplishing the restraining of the occurrence of coarse-grained particles.

The heat treatment of electrostatic recording toner by use of the apparatus shown in FIG. 15 will be described below:

In the apparatus of FIG. 15, the airflow quantity QT supplied to heat-treatment chamber 4 is the sum of particles-dispersing airflow quantity QNT, heated airflow quantity QH, upper cooling airflow quantity Q1, lower cooling airflow quantity Q2, nozzle-around air curtain forming airflow quantity Q3, and heated airflow blow-off outlet cooling airflow Q4. When the relation of QT with the air-exhaust quantity Qout from exhauster 11 is $QT > Qout$, the inside pressure of the heat-treatment chamber $\Delta P$ is positive, while when the relation is $QT < Qout$, the inside pressure of the chamber becomes negative (the preferred supply airflow proportion of QNT:QH:Q1:Q2 is 1:1:3:3, and Q3 and Q4 are extemely small).

If $\Delta P$ is positive, in order to obtain the above airflow quantities, QH, Q1 and Q2 each requires the use of a blow-in fan, and the inside pressure of the chamber is positive, so that the flow line in the chamber hardly becomes in a fixed direction and tends to become a confused flow. Especially, as shown in FIG. 6, an accompanying flow due to the blown airflow is produced in the proximity of the blow-off outlet of the heated airflow, therey flying up the particles, causing the particles to attach to the surrounding wall. The inside pressure is in such a condition as not to forcibly move the particles in the exhausing direction, so that the particles attaches to the wall by the circling flow or an airflow accompanying the circling flow, or in the upper space of the chamber, the descending speed becomes in a condition close to the finally descending speed to prolong the particles' staying period, during which the particles tend to be fused to cohere to thereby become coarse-grained.

However, if the inside pressure of the chamber is negative, particularly under a condition of from −400 to 0 mm $H_2O$, the hot zone where the heated airflow encounters the particles-dispersing airflow is attracted toward the exhaust side at the lower part of the heat-treatment chamber, so that no flying-up phenomenon of the particles occurs and the staying period of the particles becomes shortened, thus extremely reducing the cohesion by thermal fusion of the particles. However, it is undesirable to render the inside pressure of the chamber negative more than is necessary. Particularly, if the pressure is rendered more negative than −400 mm $H_2O$, it would be necessary to increase the wall thickness of the chamber to withstand the outside pressure or to increase the ability of the exhaust blower, and in addition, the foregoing reduced hot zone and shortened particles' staying time may cause the heat-treatment operation to become unable to be sufficiently carried out. Generally speaking, if $\Delta P$ is made larger, the cooling airflow's blowing speed when taking in a cooling airflow from the outside becomes higher, and on the contrary the inside of the chamber tends to become disturbed by the occurrence of an airflow accompanying the high-speed airflow taken from the outside.

From this point of view, in order to prevent the attaching of the particles to the inside wall with controlling the airflow quantities QNT, QH, Q1 and Q2 and with obtaining a sufficient heat-treatment effect, the pressure condition should satisfy the condition:

$$-400 \text{ mm } H_2O \leqq P < 0 \text{ mm } H_2O,$$

preferably $-120$ mm $H_2O \leqq P \leqq -20$ mm $H_2O$, and more preferably $-120$ mm $H_2O \leqq P \leqq -40$ mm $H_2O$, and for example, $P = -80$ mm $H_2O$ is most suitable.

As has been described above, the use of the method and apparatus of the present invention enables to effectively carry out the rounding treatment of such thermoplastic powdery particles as electrostatic recording toner and the like with high yield and productivity.

In the above examples, the heat treatment of toner particles has been described, but it goes without saying that the method and apparatus are applicable to different other particles such as, for example, the heat treatment of those solvent-containing particles in the drying process.

What is claimed is:

1. An apparatus for the heat treatment of a powdery material comprising a flow-circling chamber for circling round a powdery material-dispersing airflow;

a circling flow-blowing nozzle which blows said powdery material-dispersing airflow round in the proximity of the inside of the wall of said flow circling chamber forming a hollow cone flow of said powdery material;

a heated airflow conducting means for conducting a heated airflow to the periphery of said hollow cone flow; and a heat-treatment chamber, wherein said heated airflow conducting means comprises a guide blade which guides said heated airflow downward and in the same circular direction as that of said hollow cone flow, and further comprising an air-flow direction control plate so that the heated air circling flow from said guide blade is narrowed and blown in the axial direction of said circling flow-blowing nozzle.

2. The apparatus for the heat treatment of a powdery material of claim 1 wherein a cooling airflow regulation plate and a cooling airflow conducting means are provided at the lower part of a side wall of said heat-treatment chamber.

3. The apparatus of claim 1, wherein said circling flow-blowing nozzle has an extension angle $\theta$ of $40° \leqq \theta \leqq 60°$ C.

4. The apparatus of claim 1, wherein said guide blade is provided at an angle of from 15° to 85° to the plane which crosses at right angles with the center line of said circling flow-blowing nozzle.

5. The apparatus of claim 1, wherein said guide blade is provided at an angle of from 30° to 75° to said plane which crosses at right angles with said center line of said circling flow-blowing nozzle.

6. The apparatus of claim 1, wherein said airflow direction control plate is provided at an angle of from 15° to 85° to the plane which crosses at right angles with said center line of said circling flow-blowing nozzle.

7. The apparatus of claim 1, wherein said airflow direction control plate is provided at an angle of from 30° to 75° to the plane which crosses at right angles with said center line of said circling flow-blowing nozzle.

8. The apparatus of claim 1, wherein said airflow direction control plate has the dimensional relation:

$$D/10 \leqq m$$

wherein m represents the distance beteen the bottom end of said airflow direction control plate and the ceiling of said heat-treatment chamber; and D represents the diameter of said airflow direction control plate.

9. The apparatus of claim 1, further comprising a first cooling jacket around said circling flow-blowing nozzle and an air curtain-forming means which blows a first cooling air through the gap between said first cooling jacket and said circling flow-blowing nozzle to form an air curtain.

10. The apparatus of claim 9, wherein said gap is from 0.3 mm to 2.0 mm wide.

11. The apparatus of claim 1, wherein said heated airflow conducting means has a heated airflow blow-off outlet having therearound a cooling jacket and cooling airflow conducting means which blows a cooling airflow through the gap between the periphery of said heated airflow blow-off outlet and said cooling jacket.

12. The apparatus for the heat treatment of a powdery material of claim 1, wherein said heat-treatment chamber has a side wall thereof a cooling airflow conducting means which conducts a cooling airflow into said chamber and also has on the periphery of said side wall a cooling jacket.

13. The apparatus for the heat treatment of a powdery material of claim 1, comprising a cooling airflow conducting means for conducting a cooling airflow into said heat-treatment chamber and having a cooling airflow guide blade provided at the upper part of a side wall of said heat-treatment chamber and a cooling airflow regulation plate which regulates said cooling airflow to be in a slit form.

14. The apparatus of claim I further comprising a first cooling jacket around said circling flow-blowing nozzle, an air curtain forming means which blows a first cooling air through a gap between said first cooling jacket and said circling flow-blowing nozzle to form an air curtain, and said heated airflow conducting means has a heated airflow blow-off outlet having therearound a second cooling jacket.

15. The apparatus of claim 1 further comprising an air curtain forming means around the periphery of said circling flow-blowing nozzle, and wherein said heated airflow conducting means has a heated airflow blow-off outlet having therearound a cooling jacket and cooling airflow conducting means which blows a cooling airflow through a gap between the periphery of said heated airflow blow-off outlet and said cooling jacket.

16. The apparatus of claim 15, wherein said heat-treatment chamber has on the side wall thereof a second cooling airflow conducting means which conducts a second cooling airflow into said chamber and also has on the periphery of said side wall thereof a second cooling jacket.

17. The apparatus of claim 14, further comprising a cooling airflow conducting section around the periphery of said heated airflow blow-off outlet; and a cooling airflow guide blade and a cooling airflow regulation plate are provided at the upper part of said side wall of said heat-treatment chamber, a second cooling airflow conducting means provided at the lower part of said side wall of said heat-treatment chamber, and a third cooling jacket provided around the external of said side wall of said heat-treatment chamber.

18. The apparatus of claim 4, wherein said airflow direction control plate is provided at an angle of from 30° to 75° to the plane which crosses at right angles with said center line of said circling flow-blowing nozzle.

19. The apparatus of claim 6, wherein said airflow direction control plate is provided at an angle of from 30° to 75° to the plane which crosses at right angles with said center line of said circling flow-blowing nozzle.

20. The apparatus of claim 6, wherein said airflow direction control plate has the dimensional relation:

$$D/10 \leqq m$$

wherein L represents the distance between the bottom end of said airflow direction control plate and the ceiling of said heat-treatment chamber; and D represents the diameter of said airflow direction control plate.

21. The apparatus of claim 7, wherein said airflow direction control plate has the dimensional relation:

$$D/10 \leqq m$$

wherein m represents the distance between the bottom end of said airflow direction control plate and the ceiling of said heat-treatment chamber; and D represents the diameter of said airflow direction control plate.

22. The apparatus of claim 19, wherein said airflow direction control plate has the dimensional relation:

$$D/10 \leqq m$$

wherein m represents the distance between the bottom end of said airflow direction control plate and the ceiling of said heat-treatment chamber; and D represents the diameter of said airflow direction control plate.

23. The apparatus for the heat treatment of a powdery material of claim 11, wherein said heat-treatment chamber has a dimensional relation:

$$m' = (1 \pm 0.2)m$$

wherein m′ represents the distance between the bottom end of said cooling jacket and m the ceiling of said heat-treatment chamber; and m represents the distance between the bottom end of said airflow direction control plate which is a component of said heated airflow blow-off outlet and said ceiling of said heat-treatment chamber.

24. The apparatus for the heat treatment of a powdery material of claim 12, wherein said cooling airflowing conducting means for conducting a cooling airflow into said heat-treatment chamber comprising a cooling airflow guide blade provided at the upper part of said side wall of said heat-treatment chamber and a cooling airflow regulation plate which regulates said cooling airflow to be in the slit form.

25. The apparatus for the heat treatment of a powdery material of claim 12, wherein said cooling airflow conducting means for conducting a cooling airflow into said heat-treatment chamber comprises said cooling airflow guide blade which is provided at the upper part of said side wall of said heat-treatment chamber, said cooling airflow regulation plate and a second cooling airflow conducting means which is provided at the lower part of said side wall of said heat-treatment chamber.

26. The apparatus for the heat treatment of a powdery material of claim 13 wherein a second cooling airflow conducting means is provided at the lower part of said side wall of said heat-treatment chamber.

27. The apparatus for the heat treatment of a powdery material of claim 24 wherein a second cooling airflow conducting means is provided at the lower part of said side wall of said heat-treatment chamber.

* * * * *